US009570809B2

(12) United States Patent
Ganchrow et al.

(10) Patent No.: US 9,570,809 B2
(45) Date of Patent: Feb. 14, 2017

(54) TECHNIQUES FOR DESIGNING MILLIMETER WAVE PRINTED DIPOLE ANTENNAS

(71) Applicant: QUALCOMM INCORPORATED, San Diego, CA (US)

(72) Inventors: Elimelech Ganchrow, Zikhron Ya'akov (IL); Ofer Markish, Emek Hefer-Beerotaim (IL); Iddo Diukman, Haifa (IL); Alon Yehezkely, Haifa (IL)

(73) Assignee: Qualcomm Incorporated, San Diego, CA (US)

( * ) Notice: Subject to any disclaimer, the term of this patent is extended or adjusted under 35 U.S.C. 154(b) by 214 days.

(21) Appl. No.: 14/296,875

(22) Filed: Jun. 5, 2014

(65) Prior Publication Data

US 2014/0361946 A1 Dec. 11, 2014

Related U.S. Application Data

(60) Provisional application No. 61/831,963, filed on Jun. 6, 2013, provisional application No. 61/881,123, filed on Sep. 23, 2013, provisional application No. 61/881,119, filed on Sep. 23, 2013, provisional application No. 61/925,011, filed on Jan. 8, 2014.

(51) Int. Cl.

| | |
|---|---|
| ***H01Q 1/38*** | (2006.01) |
| ***H01Q 9/28*** | (2006.01) |
| ***H01Q 1/24*** | (2006.01) |
| ***H01Q 19/30*** | (2006.01) |

(52) U.S. Cl.

CPC ..... *H01Q 9/285* (2013.01); *H01Q 1/243* (2013.01); *H01Q 1/38* (2013.01); *H01Q 19/30* (2013.01)

(58) Field of Classification Search

CPC ..... H01Q 19/30; H01Q 1/38; H01Q 9/285
USPC ..... 343/700 MS, 795, 821, 846, 859
See application file for complete search history.

(56) References Cited

U.S. PATENT DOCUMENTS

| | | | | |
|---|---|---|---|---|
| 5,274,391 | A * | 12/1993 | Connolly | H01Q 21/10 343/789 |
| 5,532,708 | A * | 7/1996 | Krenz | H01Q 9/40 343/795 |
| 6,114,997 | A | 9/2000 | Lee et al. | |
| 6,476,773 | B2 * | 11/2002 | Palmer | H01Q 1/08 343/700 MS |
| 8,174,336 | B2 | 5/2012 | Kim et al. | |
| 8,269,672 | B2 | 9/2012 | Tinaphong et al. | |
| 2008/0158081 | A1 | 7/2008 | Rofougaran | |
| 2009/0295667 | A1 | 12/2009 | Ma et al. | |
| 2011/0037678 | A1 | 2/2011 | Tang et al. | |
| 2012/0218156 | A1 | 8/2012 | Mohammadian | |
| 2013/0082893 | A1 | 4/2013 | Wang et al. | |

(Continued)

FOREIGN PATENT DOCUMENTS

| | | | |
|---|---|---|---|
| DE | 2020192 | A1 | 11/1971 |
| EP | 2575213 | A1 | 4/2013 |
| GB | 765465 | A | 1/1957 |

*Primary Examiner* — Tho G Phan

(57) ABSTRACT

A printed millimeter wave dipole antenna and techniques for designing such an antenna are disclosed. In one embodiment, the dipole antenna comprises: a signal wing and at least one ground wing for propagating signals in a millimeter wave band; and an unbalanced feeding structure directly coupled to the signal wing. The unbalanced feeding structure is boarded by a plurality of escorting vias to ensure equipotential grounds.

10 Claims, 12 Drawing Sheets

(56) References Cited

U.S. PATENT DOCUMENTS

| | | | |
|---|---|---|---|
| 2014/0055208 | A1 | 2/2014 | Kondo et al. |
| 2014/0292604 | A1 | 10/2014 | Kaneda et al. |
| 2015/0070228 | A1 | 3/2015 | Gu et al. |
| 2015/0194736 | A1 | 7/2015 | Diukman et al. |

* cited by examiner

TECHNIQUES FOR DESIGNING MILLIMETER WAVE PRINTED DIPOLE ANTENNAS

CROSS-REFERENCE TO RELATED APPLICATIONS

This application claims the benefit of U.S. Provisional Application No. 61/831,963 filed Jun. 6, 2013, U.S. Provisional Application No. 61/881,123 filed Sep. 23, 2013, U.S. Provisional Application No. 61/881,119 filed Sep. 23, 2013, and U.S. Provisional Application No. 61/925,011 filed on Jan. 8, 2014. All of the applications referenced above are herein incorporated by reference.

TECHNICAL FIELD

The present invention relates generally to millimeter wave radio frequency (RF) systems and, more particularly, to efficient design of antennas operable in the millimeter wave frequency band.

BACKGROUND

The 60 GHz band is an unlicensed band which features a large amount of bandwidth and a large worldwide overlap. The large bandwidth means that a very high volume of information can be transmitted wirelessly. As a result, multiple applications, each requiring transmission of large amounts of data, can be developed to allow wireless communication around the 60 GHz band. Examples for such applications include, but are not limited to, wireless high definition TV (HDTV), wireless docking stations, wireless Gigabit Ethernet, and many others.

In order to facilitate such applications, there is a need to develop integrated circuits (ICs) such as amplifiers, mixers, radio frequency (RF) analog circuits, and active antennas that operate in the 60 GHz frequency range. An RF system typically comprises active and passive modules. The active modules (e.g., a phased array antenna) require control and power signals for their operation, which are not required by passive modules (e.g., filters). The various modules are fabricated and packaged as radio frequency integrated circuits (RFICs) that can be assembled on a printed circuit board (PCB). The size of the RFIC package may range from several to a few hundred square millimeters.

In the consumer electronics market, the design of electronic devices, and thus RF modules integrated therein, should meet be designed to minimize cost, size, power consumption, and weight. The design of the RF modules should also take into consideration the current assembled configuration of electronic devices and, particularly, handheld devices such as laptop, smartphones, and tablet computers, in order to enable efficient transmission and reception of millimeter wave signals. Furthermore, the design of the RF module should account for minimal power loss of receive and transmit RF signals as well as for maximum radio coverage.

A schematic diagram of a RF module 100 designed for transmission and reception of millimeter wave signals is shown in FIG. 1. The RF module 100 includes an array of active antennas 110-1 through 110-N connected to a RF circuitry or IC 120. Each of the active antennas 110-1 through 110-N may operate as a transmit (TX) and/or a receive (RX) antenna. An active antenna can be controlled to receive/transmit radio signals in a certain direction, to perform beam forming, and to switch between receive and transmit modes. For example, an active antenna may be a phased array antenna in which each radiating element can be controlled individually to enable the usage of beam-forming techniques.

In the transmit mode, the RF circuitry 120 typically performs up-conversion, using a mixer (not shown in FIG. 1), to convert intermediate frequency (IF) signals to radio frequency (RF) signals. Then, the RF circuitry 120 transmits the RF signals through the TX antenna according to the control signal. In the receive mode, the RF circuitry 120 typically receives RF signals through the active RX antenna and performs down-conversion, using a mixer, to IF signals using the local oscillator (LO) signals, and sends the IF signals to a baseband module (not shown in FIG. 1).

In both receive and transmit modes, the operation of the RF circuitry 120 is controlled by the baseband module using a control signal. The control signal is utilized for functions such as gain control, RX/TX switching, power level control, beam steering operations, and so on. In certain configurations, the baseband module also generates the LO and power signals and transfers such signals to the RF circuitry 120. The power signals are DC voltage signals that power the various components of the RF circuitry 120. Normally, the IF signals are also transferred between the baseband module and the RF circuitry 120.

In common design techniques, the array of active antennas 110-1 to 110-N are implemented on the substrate upon which the IC of the RF circuitry 120 is also mounted. An IC is typically fabricated on a multi-layer substrate and metal vias that connect between the various layers. The multi-layer substrate may be a combination of metal and dielectric layers and can be made of materials such as a laminate (e.g., FR4 glass epoxy, Bismaleimide-Triazine), ceramic (e.g., low temperature co-fired ceramic LTCC), polymer (e.g., polyimide), PTFE (Polytetrafluoroethylene) based compositions (e.g., PTFE/Ceramic, PTFE/Woven glass fiber), Woven glass reinforced materials (e.g., woven glass reinforced resin), wafer level packaging, and other packaging, technologies and materials. The cost of the multi-layer substrate is a function of the area of the layer—the greater the area of the layer, the greater the cost of the substrate.

Antenna elements of the array of active antennas 110-1 to 110-N are typically implemented by having metal patterns in a multilayer substrate. Each antenna element can utilize several substrate layers. In conventional implementations for millimeter wave communications, antenna elements are designed to occupy a single side of the multi-layer substrate side. This is performed in order to allow the antenna radiation to properly propagate.

For example, a millimeter wave (mm-wave) RF module 200 depicted in FIG. 2 includes a multi-layer substrate 210 and a plurality of antenna elements 220 implemented on an upper layer of the substrate 210. The antenna elements 220 are connected to a RF circuitry 230 using traces 201. The RF circuitry 230 performs the function discussed in greater detail above. The RF module 200 may also contain discrete electronic components 240 such as an antenna interface in an implementation of chip-board transition structure, which typically includes the IC (chip) package and transmission lines from the IC to the substrate. Additionally, circuits designed for impedance matching and electrostatic discharge (ESD) protection may also be part of the antenna interface.

In order to maximize the coverage of a millimeter wave RF module, the RF module operates according to the specification of the IEEE 802.11ad (also known as the WiGig), such that a large number of antennas should be included in the RF module. Some conventional RF designs require implementing a number of active antennas on one side of the substrate, thereby providing a constraint that limits the number of antennas of the RF module. Another conventional design includes placing a number of antennas on different sides of the substrate, thereby enabling the RF signal to radiate in all directions.

In both of the above noted approaches, an attempt to increase the number of active antennas would require increasing the area of substrate. Also, such an attempt would require increasing the length of the wires (traces) from the RF circuitry to the antenna elements. Further, some antennas require differential signal feeding via, e.g., a balun structure which consumes substrate area. In this case, a problem arises as some area of the substrate should be reserved for other structures, such as antenna feed lines. Any design of a RF module designed with a large number of antennas should meet the constraints of an efficient design. Such constraints necessitate that the physical dimensions, power consumption, heat transfer, and cost be minimized whenever possible.

Typically, the antennas that require differential signal feeding via, e.g., a balun structure, are dipole and Yagi-types antennas. More specifically, a dipole antenna is typically fed by two arms that are 180° out of phase with respect to each other. The arms must have equal electric field amplitude distribution. When a dipole is fed from an unbalanced source (unequal field distribution), such as a coax or microstrip, a balun is used to transition the source transmission line from an unbalanced state to a balanced state. The balanced transmission line is generally in the form of a two-wire line.

Additionally, when fed over a ground plane, a dipole antenna needs to be on the order of a quarter-wavelength from the ground so that the dipole is not shorted to the ground plane.

In existing solutions, the feed line from the ground to the dipole is typically designed using a balanced line. The balun is implemented in an earlier stage of the antenna as a separate component. This requires more space and line length, which are disadvantages in a system that is space limited. Other solutions use the quarter wavelength section from the ground as a matching section and part of the balun. However, this type of balun cannot support a broadband frequency range.

Another design constraint that should be considered when providing an RF module with a large number of millimeter-wave antennas is the connection of an antenna to multiple amplifiers for increased transmission power and/or reception sensitivity. Typically, such a connection requires an extra circuit element: a power combiner. The power combiner can be in the form of a simple T-junction or a more complex Wilkinson divider. In either case, extra line length and circuitry must be added for the combiner and any associated matching network. As a result, a problem arises with such designs as the area of the substrate is limited and should be reserved for other structures. Thus, an attempt to increase the number of antennas in a mm-wave RF module while meeting the above-noted constraints would significantly increase the area of the module's substrate and, therefore, reduce the efficiency of the RF module.

It would be therefore advantageous to provide an efficient design for mm-wave antennas that overcomes the disadvantages noted above.

SUMMARY

Certain embodiments disclosed herein include a printed millimeter wave dipole antenna. In one embodiment, the dipole antenna comprises: a signal wing and at least one ground wing for propagating signals in a millimeter wave band; and an unbalanced feeding structure directly coupled to the signal wing, wherein the unbalanced feeding structure is boarded by a plurality of escorting vias to ensure equipotential grounds.

In another embodiment, the dipole antenna comprises a first dipole wing and a second dipole wing for propagating signals in a millimeter wave band; and a balanced feeding structure construed to include a first feed stripline connected to the first dipole wing and the second feed stripline connected to the second dipole wing.

In yet another embodiment, the dipole antenna comprises a first dipole wing and a second dipole wing for propagating signals in a millimeter wave band; and a balanced feeding structure construed to include a feed stripline and a balun, wherein the dipole antenna is printed on a metal layer between ground layers of a substrate.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
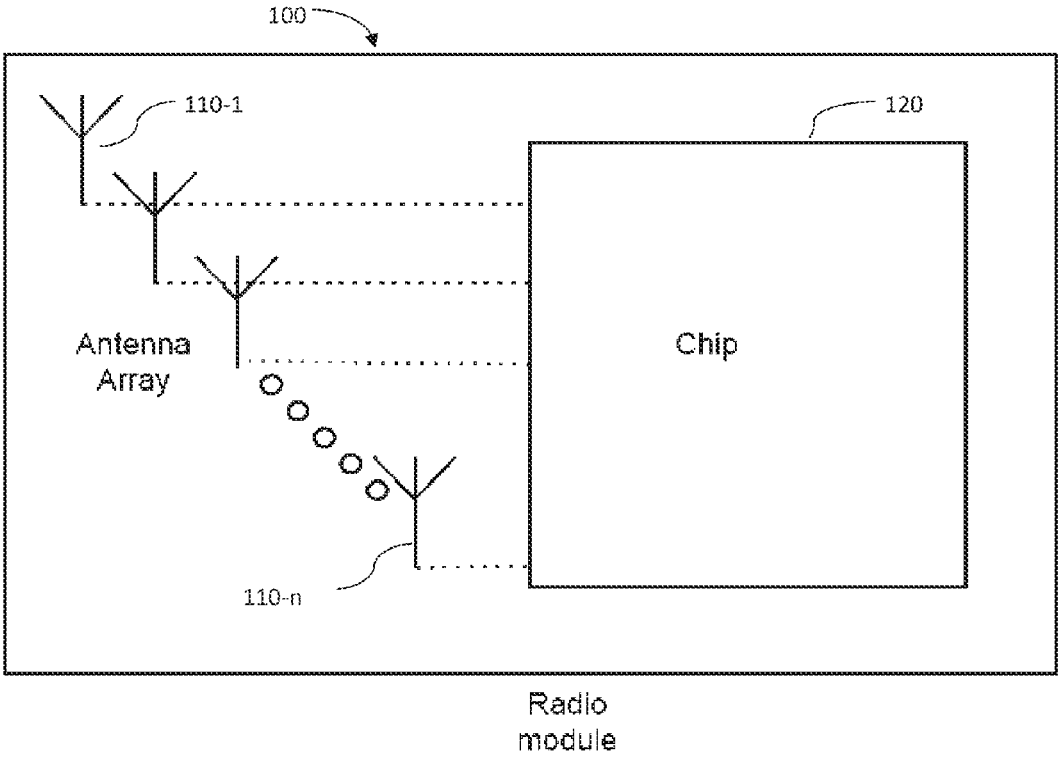
FIG. 1 is a schematic diagram illustrating a RF module with an array of active antennas.

It is important to note that the embodiments disclosed herein are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality. In the drawings, like numerals refer to like parts through several views.

As noted above, in order to increase the radio coverage of a mm-wave RF module, a large number of antennas should be included in the module. Various mm-wave antennas designed to allow a compact RF module while meeting design constraints are disclosed herein. The disclosed embodiments also include techniques for designing such mm-wave antennas.

According to one embodiment, a stripline fed dipole antenna may not include an explicit balun. Typically, a balun structure is utilized in an antenna fed with a differential signal. The disclosed embodiment allows designing a RF module with a differential dipole antenna while minimizing the substrate area.

Figure 3A:
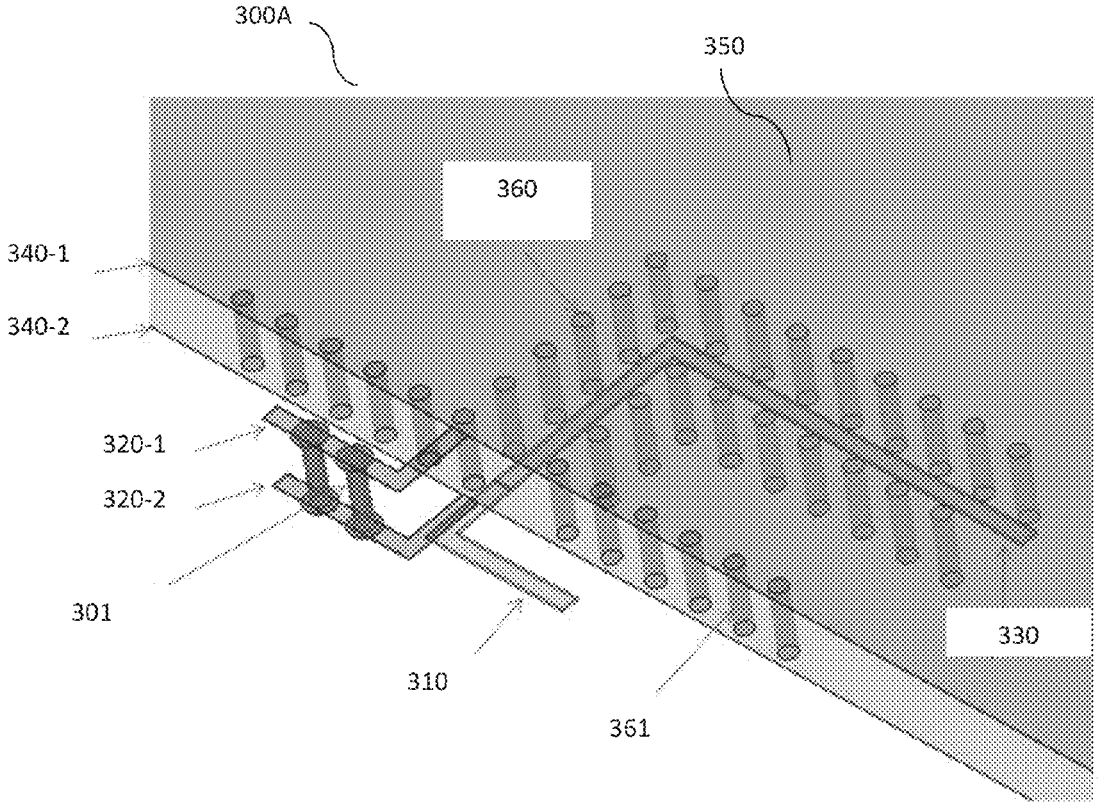
FIGS. 3A and 3B are a perspective view and a top view, respectively, of a stripline fed dipole structure according to one embodiment.

FIG. 3A shows a perspective view 300A of a stripline fed dipole antenna according to one embodiment. The antenna is a dipole antenna comprising a signal wing 310 and ground wings 320-1 and 320-2 (ground wings 320-1 and 320-2 hereinafter referred to individually as a ground wing 320, or collectively as ground wings 320). Two connecting vias 301 connect between the ground wings 320-1 and 320-2 in order to create an effective single equipotential ground wing.

Figure 2:
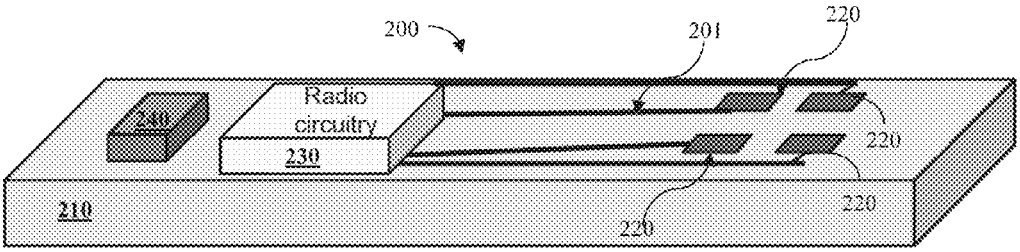
FIG. 2 is a diagram illustrating the assembly of a RF module and a plurality of antenna elements on a multi-layer substrate.

The signal wing 310 is fed through a stripline 330. In one embodiment, the stripline 330 is a transmission line guided by two ground layers 340-1 and 340-2 of substrate 350. The substrate 350 is the substrate of the RF module (see for example, FIG. 2). The stripline 330 is directly connected to the signal wing 310 of the dipole. In an embodiment, the ground wings 320 are respectively connected to the top and bottom grounds 340-1 and 340-2 sandwiching the stripline 330. In an embodiment, the dipole antenna is printed on a substrate.

Figure 3B:
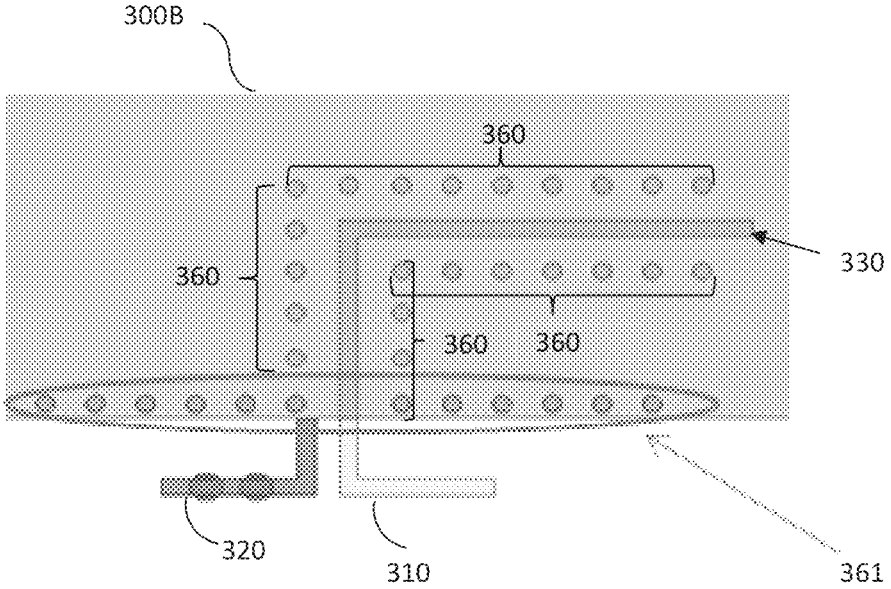

FIG. 3B shows a top view 300B of the disclosed stripline fed dipole antenna illustrated in FIG. 3A. In one embodiment, the stripline 330 is boarded by a plurality of escorting vias 360 to ensure equipotential grounds. In an embodiment, shielding vias 361 which are part of the escorting vias 360 continue as back shielding vias parallel to the aperture such that minimal radiation energy is coupled back to the ground layers.

In an exemplary embodiment, the length of each of the dipole wings 310 and 320 is about a quarter of wavelength in the material and together the dipole wings form a simple and efficient half wavelength dipole. The distance between the shielding vias 361 and the dipole wings 310 and 320 is also about one quarter wavelength in the material in order to ensure constructive interference and forward radiation direction. The disclosed stripline fed dipole antenna is specifically designed to transmit/receive millimeter wave signals at the 60 GHz frequency band.

The stripline fed dipole antenna illustrated in FIGS. 3A and 3B can serve as an end-fire antenna. End-fire antenna use in antenna sub-arrays is described in more detail in U.S. patent application Ser. No. 13/729,553, now pending, titled "TECHNIQUES FOR MAXIMIZING THE SIZE OF AN ANTENNA ARRAY PER RADIO MODULE", assigned to common assignee and incorporated herein by reference.

It should be appreciated from FIGS. 3A and 3B that the dipole antenna is fed without a balun device or structure. A balun device, in any form, performs a conversion function of a balanced signal to an un-balanced signal. A balanced signal travels on a transmission line with equal impedances on the two conductors relative to real or virtual ground, while an unbalanced signal travels on a transmission line with unequal impedances on the two conductors relative to real or virtual ground. Thus, feeding an antenna without a balun device can negatively impact the performance of the antenna. In an embodiment, to mitigate any un-balancing performance, the ground wings 320 and the signal wing 310 are designed to have an optimal distance from each other that creates proper impedance in the feed area. In addition, the shape and length of the stripline 330 is adjusted to optimize the performance of the antenna. Parameters such as the distance of feed line bend from the dipole and the amount of escorting vias affect the match of the antenna. As will be demonstrated in FIG. 6, a matching bandwidth achieved using the disclosed structure satisfies optimal performance.

It should be noted that the stripline fed antenna, once designed to meet the constraints, permanently remains after the design process such that the structure performance can be optimized despite the un-balanced signals caused due to the lack of a balun device feeding the antenna.

Figure 4:
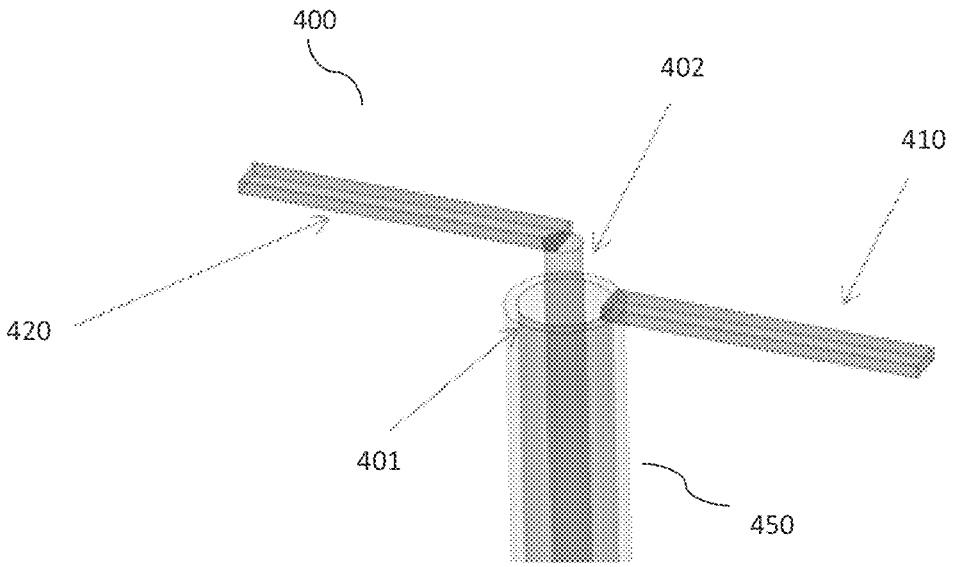
FIG. 4 is a schematic diagram of a coax fed dipole without an explicit balun according to one embodiment.

FIG. 4 shows a schematic diagram of a coax fed dipole antenna 400 implemented without an explicit balun. In one embodiment, an outer cylinder 401 of a coax cable 450 feeds a ground wing 410 of the dipole antenna and an inner cylinder 402 of the coax cable 450 feeds a signal wing 420 of the diploe antenna 400. As illustrated in FIG. 4, the dipole antenna coax feed dipole 400 does not require any balun device to feed the antenna, as the dipole wings are coupled directly to the coax cable. In this embodiment, like in the stripline fed antenna (shown in FIGS. 3A, 3B), optimization of the length that center-conductor 402 extends beyond outer-conductor 401 becomes part of the impedance match of the antenna.

Figure 5:
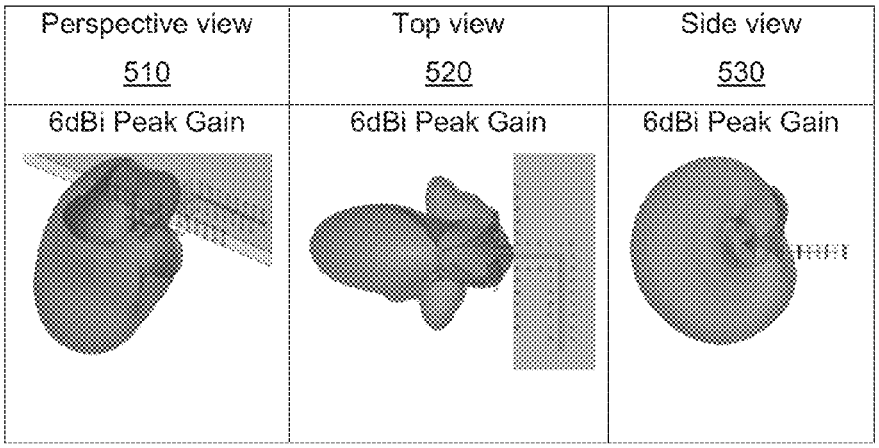
FIG. 5 illustrates several gain patterns simulated for a stripline fed dipole.

FIG. 5 shows simulated radiation gain patterns of a stripline fed dipole antenna designed according to an embodiment without an explicit balun device. The gain patterns as shown in diagrams 510, 520, and 530 are relative to the dipole antenna and depict such gains from perspective, top, and side views, respectively. In the diagram shown in FIG. 5, the forward radiation pattern simulated at a frequency of 60 GHz, the peak gain is around 6 dBi and the total efficiency is 81%. Total efficiency is a measure of the percentage of input power that is actually radiated from the antenna after taking mismatch losses and ohmic losses into account.

Figure 6:
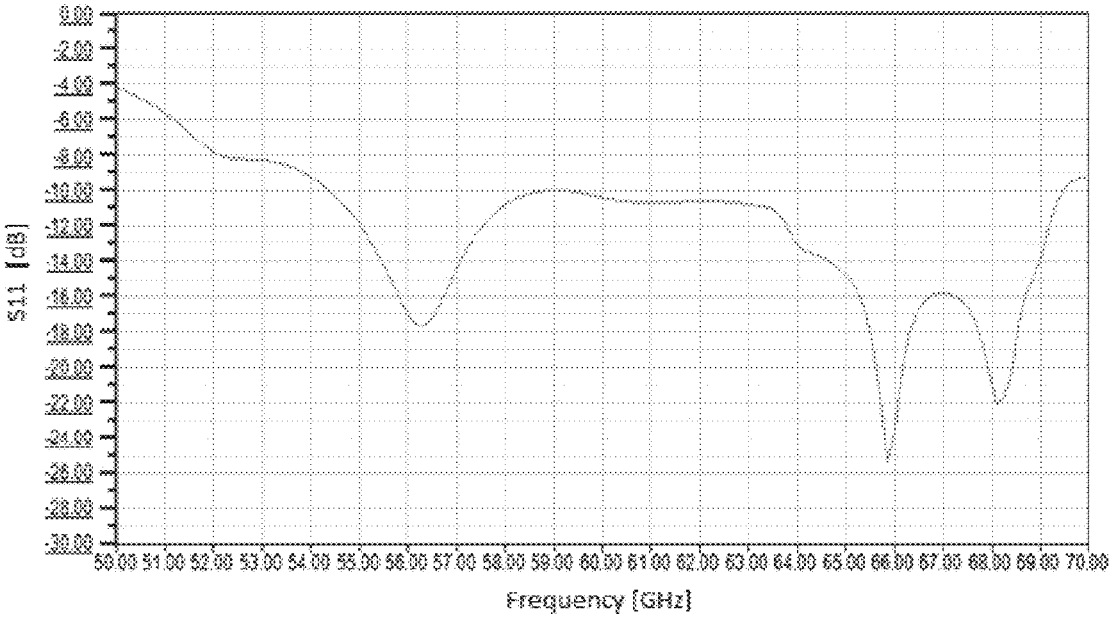
FIG. 6 is a simulation graph showing the matching bandwidth achieved with a stripline fed dipole structure configured according to an embodiment.

FIG. 6 depicted the matching bandwidth simulated for the stripline fed dipole antenna designed according to an embodiment without an explicit balun device. As can be noted in FIG. 6, the matching bandwidth simulated for the antenna is around 25%. The matching bandwidth is the frequency range over which an RF device is sufficiently matched to its source impedance. It should be appreciated by one of ordinary skill that the matching bandwidth of 25% is similar to a bandwidth achieved when using an isolated balanced dipole antenna—thus, the disclosed antenna design without a balun device does not cause matching degradation.

In another embodiment, a millimeter-wave dipole antenna is printed on a multilayer substrate and is fed by two separate stripline feed points that combine to a differential line at the antenna. Such a structure behaves as an antenna, as a power combiner, and as a stripline to a differential line transformer all in one package or element. According to an embodiment, the combined element can be implemented as a single dipole or as a dipole that feeds Yagi-Uda type directors.

Figure 7:
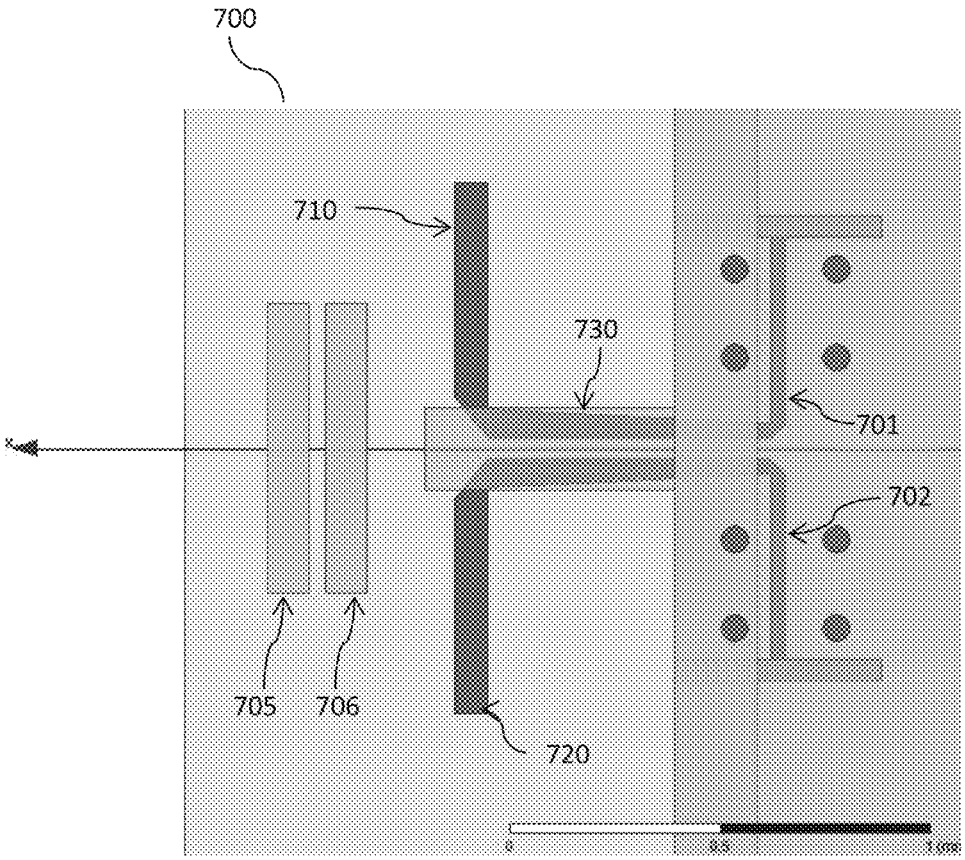
FIG. 7 is a cross-sectional diagram illustrating a millimeter-wave dipole antenna printed on a multilayer substrate according to one embodiment.

FIG. 7 shows an exemplary and non-limiting view of a millimeter wave dipole antenna 700 printed on a multilayer substrate according to one embodiment. The dipole antenna 700 is constructed using two wings 710 and 720 designed to provide a quarter wave-length dipole antenna that is fed from stripline feeds 701 and 702. Typically, a RF module includes many output transmitter/receiver amplifier chains, and each chain has an output to feed an antenna. For a single dipole an output is taken from two of these chains and brought together at the ground plane's edge. The feed striplines 701 and 702 are tapered to match closely to differential feed lines of the dipole antenna.

A section 703 of the ground plane extends out over the differential feed line in order to reduce the impedance of the line to improve the impedance match. The design shown in FIG. 7 removes all associated elements with the balun and power combiner, thereby saving area of the substrate and reducing signal loss. Specifically, the disclosed structure of a dipole antenna can be fed without a balun by using two stripline feeds. The stripline feeds 701 and 702 are of equal amplitude and are out of phase from their respective amplifiers.

It should be further noted that the dipole antenna structure as shown in FIG. 7 can serve as a power combiner. This may be achieved by bringing the stripline feeds 701 and 702 together at the antenna interface and matching the stripline to antenna impedance without the need for further matching circuitry.

According to another embodiment, the antenna dipole 700 can act as a Yagi-Uda driven element. A Yagi-Uda antenna is a directional antenna that includes a driven element and additional parasitic elements, commonly known as directors. According to this embodiment, a ground layer of the substrate of the RF module (see for example, FIG. 2) acts as the reflector and the antenna dipole 700 includes directors 705 and 706, which are placed in front of the dipole's wings 710 and 720. A director is a metal line designed to resonate at the main frequency, e.g., 60 GHz.

In one embodiment, the directors 705 and 706 can be placed in the same plane with the dipoles wings' and grounds' plane. In another embodiment, not shown in FIG. 7, the directors 705 and 706 can be placed above and/or below the plane of the dipole at the same radial distance from the dipole as the in plane director. This arrangement increases the gain of the antenna without increasing the lateral extent of the array in which the antenna operates. It should be noted that the directors 705 and 706 only look to be in the same plane in FIG. 7 because of the view of the drawing.

Figure 8:
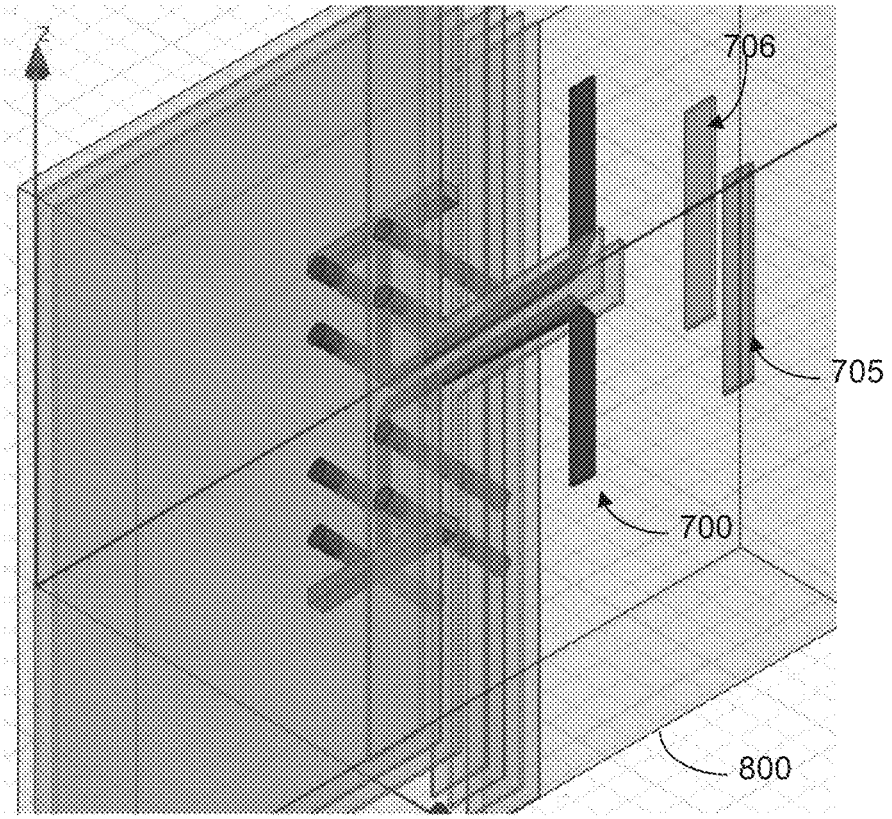
FIG. 8 is an isometric diagram illustrating a millimeter-wave dipole antenna printed on a multilayer substrate.

FIG. 8 is an exemplary and non-limiting isometric diagram 800 illustrating the wave dipole antenna 700 printed in the multilayer substrate 800. FIG. 8 illustrates the placement of directors 705 and 706 with respect to the dipole.

Figure 9:
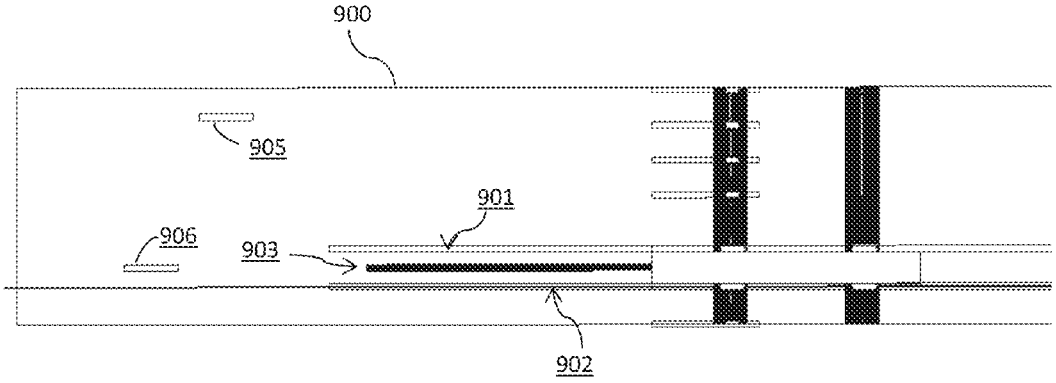
FIG. 9 is a schematic diagram of a stripline launched differentially fed antenna designed according to an embodiment.

FIG. 9 is a cross-section diagram 900 of a stripline launched differentially fed antenna designed according to one embodiment. In this embodiment, two stripline feeds shown together as a signal line 903 emanates directly from the signal layer of the stripline. The stripline ground matching posts 901 and 902 emanate directly from the stripline ground layers. Two directors (e.g., directors 905 and 906) are shown in this embodiment. They are both located at the same radial distance from the dipole element. One of the directors is in the plane of the dipole (e.g., director 906), while the other director (e.g., director 905) is raised above the plane of the dipole.

It should be appreciated that the proposed solution allows the antenna to cover an appropriately broad bandwidth in a dense antenna environment with less impact on the routing and feeding footprint because the balun, power divider, and impedance transformer are all incorporated into the structure of the antenna. The proposed solution is also useful in designs where high gain and beam forming requirements demand the use of multiple antennas and architecture limitations require that they be fitted in a small area. It should be further appreciated that the proposed solution allows the antenna to be fed with twice the output power, or a 3 dB increase in equivalent isotropically radiated power (EIRP), without external circuitry.

In another embodiment, a millimeter-wave dipole antenna is printed on a multilayer substrate and fed by a tapered balun. The tapered balun transitions from unbalanced stripline to balanced stripline and is part of the quarter wave-length section that feeds the dipole from the ground plane to save space. In one embodiment, the tapered balun can also be utilized to feed Yagi-Uda type directors.

Figure 10:
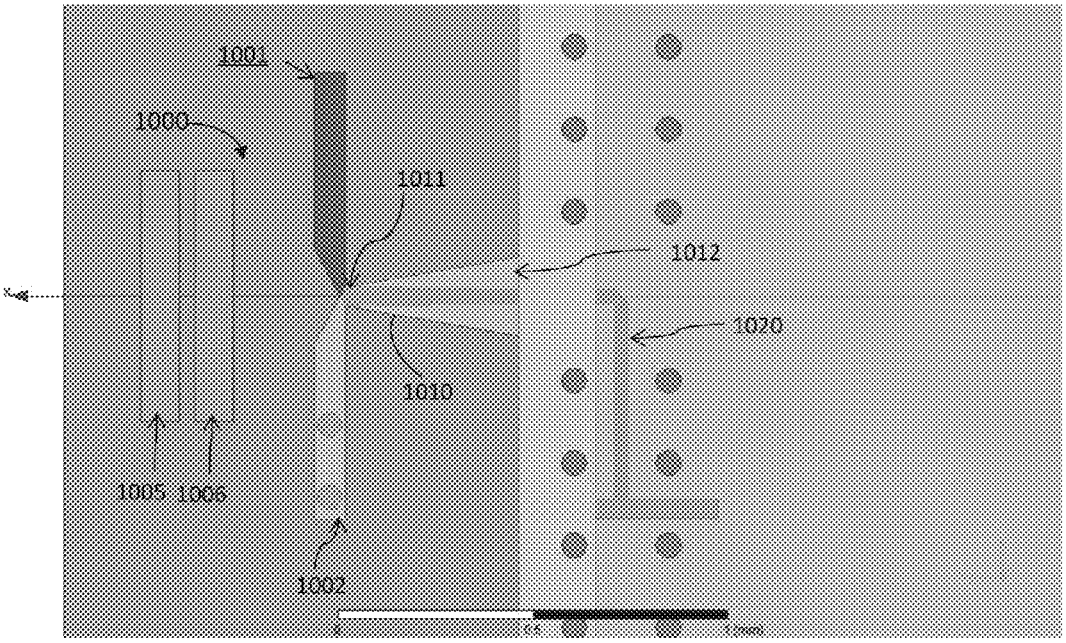
FIG. 10 is a cross-sectional diagram illustrating a millimeter-wave dipole antenna with a tapered balun printed on a multilayer substrate according to an embodiment.

FIG. 10 shows an exemplary and non-limiting illustration of a millimeter-wave dipole antenna 1000 printed on a multilayer substrate according to one embodiment. The dipole antenna 1000 is structured using two wings (or arms) 1001 and 1002, where the wing 1002 is a ground wing. In this embodiment, the dipole antenna 1000 is a half wave-length antenna fed with an element that includes a tapered balun 1010 and a stripline transmission line 1020. In an embodiment, the stripline transmission line 1020 can be replaced by a microstrip line.

The tapered balun 1010 extends from the ground layers to the signal wing 1001. In one embodiment, the tapered balun is shaped as a trapezoid where the base 1012 of the tapered balun 1010 is wider than the base 1011. In one embodiment, the base 1012 tapers to the width of the signal line at the feed point of the balun 1010. The width of the base 1012 is designed to be several ground layer (plane) spacings wide, where ground layer spacing is the dielectric thickness between the ground layer and signal layer in a microstrip or stripline transmission line.

The length of the base 1012 should be determined based on several considerations. These considerations may include, but are not limited to, impedance and balance effects and ground space effects. As a non-limiting example, if the based 1012 is too wide, then the taper 1010 can act as an extended ground plane for the dipole distributing the quarter wave spacing. Also, because after two or three ground plane spacings from the signal line the electric field is very weak, there is no benefit of having the taper start out wider than more than two to three ground plane spacings. In another non-limiting example, if the base 1012 of a tapered balun 1010 is too narrow, this would result in a large discontinuity, thereby disturbing the balance of the feed lines and the impedance match causing a reduction in impedance bandwidth. The discontinuity also makes the feed line sensitive to other bends and radii in the feed network. In an exemplary and non-limiting embodiment, the width of the base is 2 ground plane spacings.

According to another embodiment, the antenna dipole 1000 can act as a Yagi-Uda driven element. In this embodiment, the ground layer of the substrate of the RF module acts as the reflector and signal directors 1005 and 1006 are placed in front of the dipole wings 1001 and 1002. In one embodiment, the directors 1005 and 1006 can be placed in the plane with the dipoles wings and ground's planes, respectively. In another embodiment, the directors 1005 and 1006 can be placed above and/or below the plane of the dipole at the same radial distance from the dipole as the in plane director. This arrangement increases the gain of the antenna without increasing the lateral extent of the array. It should be noted that the directors 1005 and 1006 appear to be in the same plane in FIG. 10 merely because of the view of the drawing.

Figure 11:
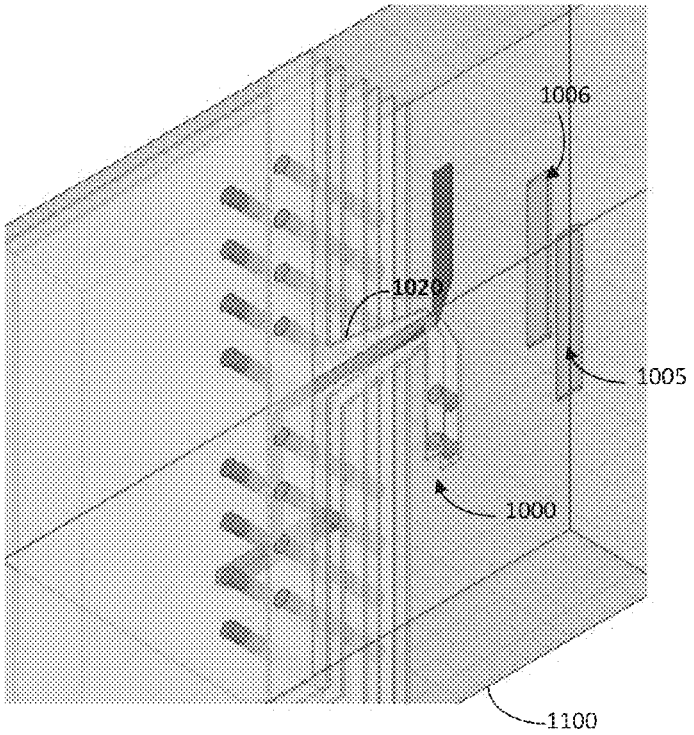
FIG. 11 is an isometric diagram illustrating a millimeter-wave dipole antenna with a tapered balun printed on a multilayer substrate according to an embodiment.

FIG. 11 is an exemplary and non-limiting isometric diagram illustrating the millimeter wave dipole antenna 1000 as printed in the multilayer substrate 1100. FIG. 11 also illustrates the placement of directors 1005 and 1006 with respect to the dipole. In one embodiment, the antenna 1000 is printed on different substrates with varying dielectric constants and loss tangents. The dipole antenna 1000 can be fed from a microstrip line with only one ground plane.

Figure 12:
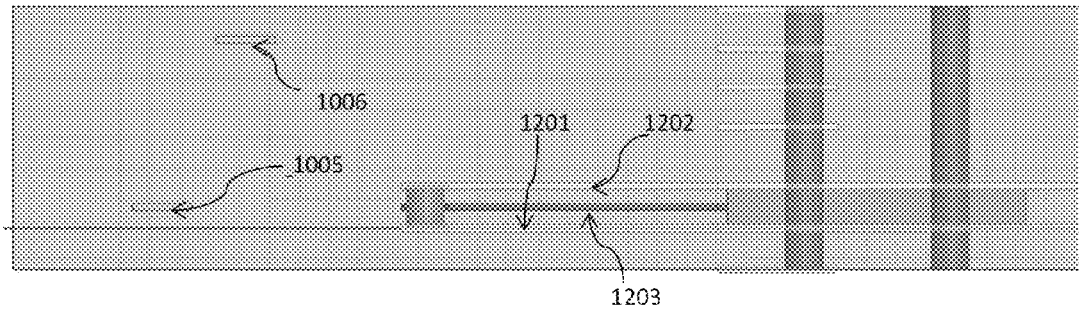
FIG. 12 is a schematic diagram illustrating a millimeter-wave dipole antenna with a tapered balun printed on a multilayer substrate according to an embodiment.

FIG. 12 shows a cross-section diagram of the antenna dipole 1000. A signal line 1203 emanates directly from the signal layer of the stripline transmission line 1020 (not shown in FIG. 2). The tapered balun 1010 (not shown in FIG. 12) is realized using ground matching posts 1201 and 1202, which emanate directly from the stripline ground layers. Two directors 1005 and 1006 are shown in this embodiment. The two directors are both located at the same radial distance from the dipole element. One of the directors is in the plane of the dipole's wings (1001 and 1002, FIG. 10), and the other director is raised above the plain of the dipole.

It should be appreciated that the proposed solution allows the antenna to cover an appropriately broad bandwidth in a dense antenna environment with less impact on the routing and feeding footprint, since the balun and impedance transformer are all incorporated into the structure of the antenna. According to an embodiment, the tapered balun 1010 acts as an impedance transformer, allowing the dipole to be more naturally matched to its resonant impedance by tapering the feed lines at their end points to the appropriate matching impedance. It should be noted that the natural impedance of the dipole may be slightly different from the feed line. In order to optimize the antenna match, the impedance of the feed line may be changed by tapering its width to more suitable impedance for maximum power transfer.

The millimeter-wave dipole antenna 1000 can be used in antenna sub-arrays located in the middle layer of a substrate of an RF module. An example for such RF module is further discussed in U.S. patent application Ser. No. 13/729,553, referenced above.

Figure 13:
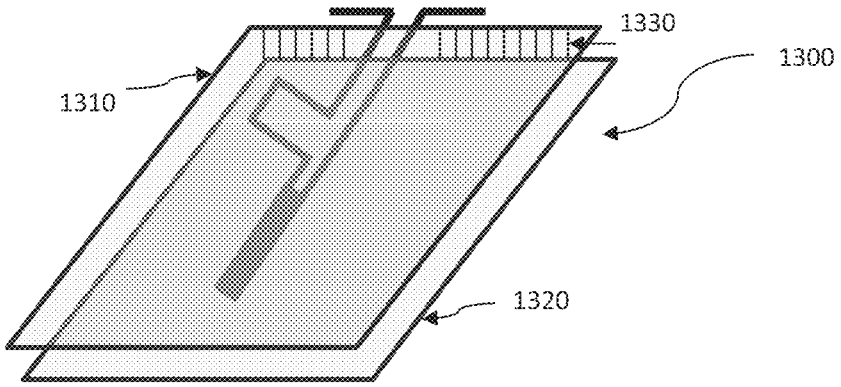
FIG. 13 is a schematic diagram of a RF module with an accompanying Quasi Yagi antenna according to an embodiment.

FIG. 13 illustrates an exemplary and non-limiting RF module with accompanying Quasi Yagi dipole antenna 1300 according to an embodiment. In the embodiment, the Quasi Yagi dipole antenna 1300 is printed on a middle (or an inner) layer of an RF module. Specifically, in one embodiment, the Quasi Yagi dipole antenna is printed on a metal layer between the two ground plane layers of the substrate. In the exemplary design illustrated in FIG. 13, a top ground layer (plane) 1310 and a bottom ground layer (plane) 1320 are separated by a via wall 1330, and the antenna is fed with a stripline and balun feed. A Quasi Yagi dipole antenna needs to radiate efficiently (matching in the entire band, and high radiation efficiency), despite the two ground planes interfering with the radiation.

Figure 14:
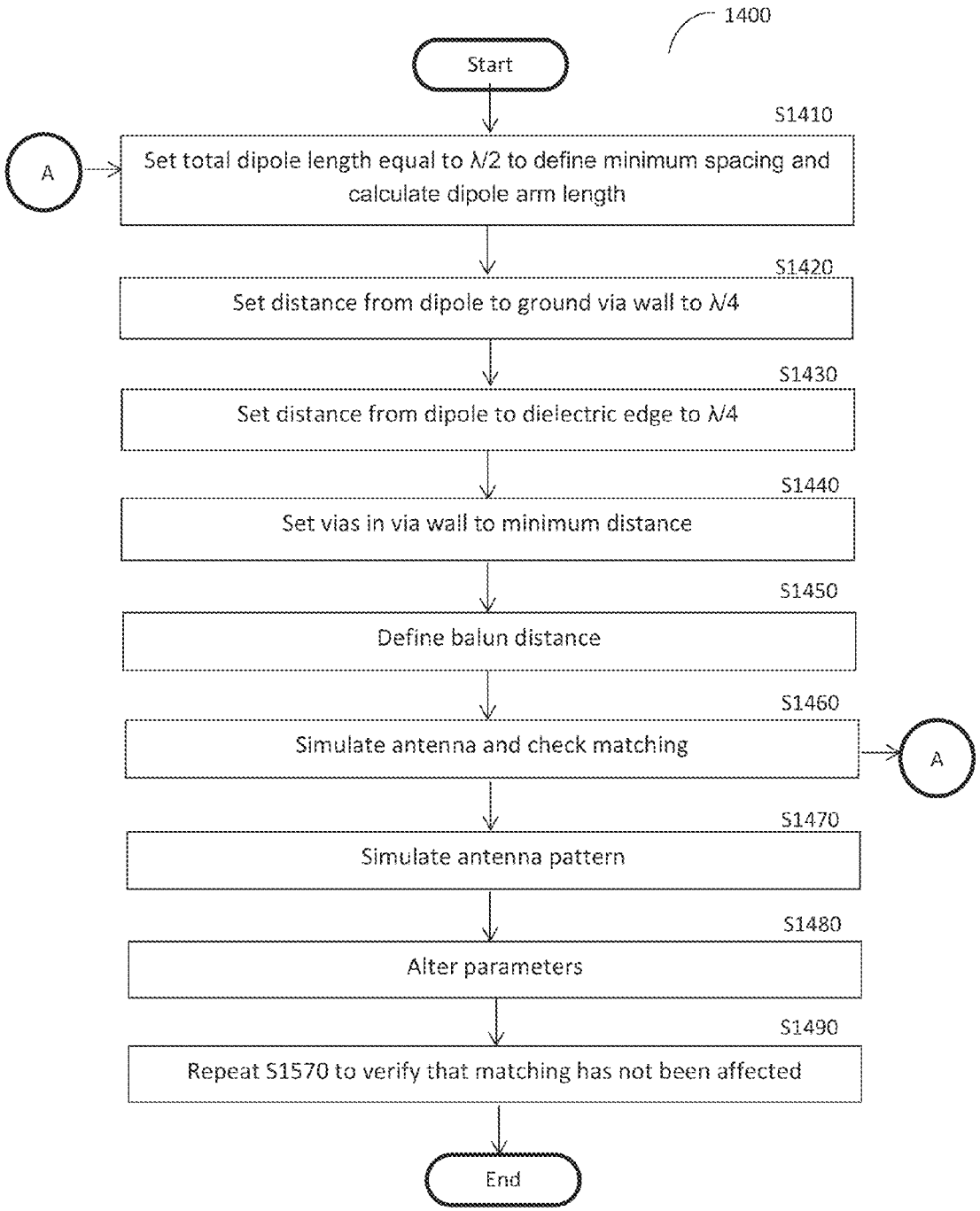
FIG. 14 is a flowchart illustrating a method for designing an optimized Quasi Yagi antenna according to an embodiment.

FIG. 14 illustrates an exemplary and non-limiting flowchart 1400 illustrating a method for designing an optimized Quasi Yagi dipole antenna according to an embodiment. At S1410, the total dipole length is set to equal wavelength ($\lambda$) divided by 2 ($\lambda/2$). Based on this total dipole length, the minimum spacing between dipole arms is defined and dipole arm lengths are calculated. At S1420, the distance from the dipole to the ground via wall is set to $\lambda/4$. At S1430, the distance from the dipole to a dielectric edge is set to $\lambda/4$. Next, at S1440, the vias in a via wall are set to the minimum distance.

At S1450, a balun distance from the ground edge is defined such that the resulting differential mode is stable. At S1460, the antenna is simulated and check matching is performed. If this step does not result in achieving sufficient bandwidth, S1410 through S1440 and S1460 are repeated after increasing the space from the ground for wider matching, increasing or decreasing dipole length to reach lower or higher center frequency, and adjusting other parameters accordingly.

Once sufficient bandwidth has been achieved, the antenna pattern is simulated at S1470. Then, at S1480, the parameters ground size, distance to ground, distance to dielectric edge, and via distance to tune pattern are changed. In some embodiments, additional directors may be added for higher gain at the expense of antenna size. At S1490, the pattern simulation performed at S1470 is repeated to verify that matching is not affected. If matching has been affected, the pattern and matching must be co-tuned.

It should be noted that the method for designing optimized Quasi Yagi antenna and the dipole antennas disclosed herein, can be implemented in any computer aided design (CAD) tools utilized in the design of RFICs.

Figure 15:
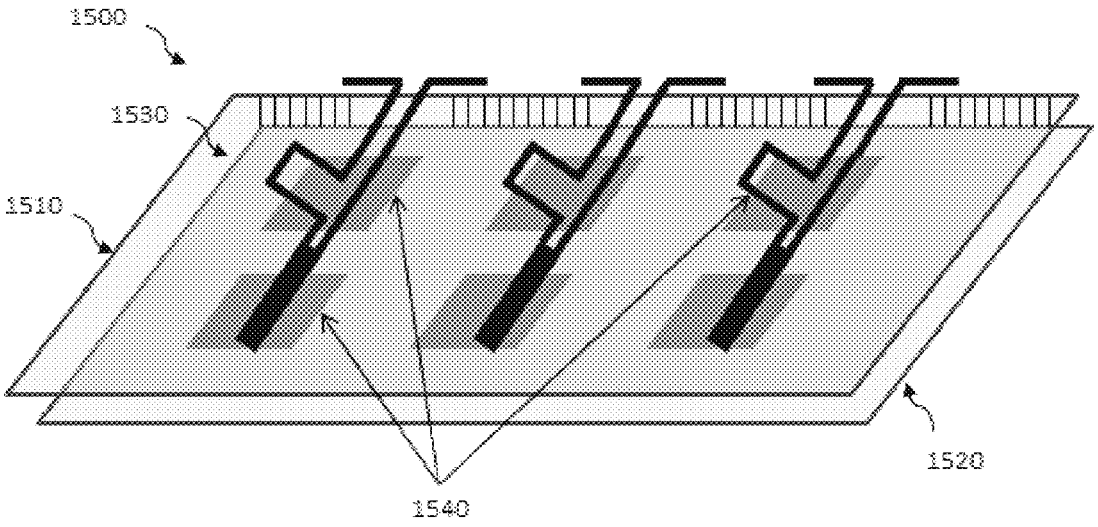
FIG. 15 is an exemplary and non-limiting RF module implemented with multiple quasi-Yagi antennas designed according to a non-limiting embodiment.

FIG. 15 illustrates an exemplary and non-limiting RF module 1500 with multiple QuasiYagi dipole antennas designed according to a non-limiting embodiment. In the embodiment, a top ground plane 1510 and a bottom ground plane 1520 are separated by a via wall 1530. As shown in FIG. 15, the Quasi Yagi dipole antenna allows integration of a plurality of antennas 1540-1 through 1540-N (N is an integer greater than 1) in the RF module 1500. In an embodiment, the plurality of antennas can be integrated in an outer layer (e.g., top and/or bottom layers) of the RF module 1500. An example from an RF module that can benefit from the design of the RF module of the multiple Quasi Yagi antennas is disclosed in the U.S. patent application Ser. No. 13/729,553, referenced above.

It is important to note that the disclosed embodiments are only examples of the many advantageous uses of the teachings discussed herein. Specifically, the teachings disclosed herein can be adapted in any type of consumer electronic devices where reception and transmission of millimeter wave signals is needed. More particularly, the teachings of the present invention can be used in design of miniaturized RFICs utilized in devices supporting applications operable in the 60 GHz frequency band. Such applications include, but are not limited to, wireless high definition TV (HDTV), wireless docking station, wireless Gigabit Ethernet, wireless local area network over 60 GHz, and many others. The 60 GHz frequency band applications are designed to be integrated in portable devices including, but not limited to, netbook computers, tablet computers, smartphones, laptop computers, and the like. It should be appreciated that as physical size of such devices is relatively small, thus the area for installing additional circuitry to support 60 GHz applications is limited, hence the disclosed techniques for designing millimeter wave antenna are highly suitable for implementation of RFICs for 60 GHz band applications.

All examples and conditional language recited herein are intended for pedagogical purposes to aid the reader in understanding the principles of the disclosed embodiments and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. An apparatus, comprising:

a substrate comprising a plurality of ground layers;

a signal wing and at least one ground wing, said at least one ground wing being coupled to at least one of the plurality of ground layers; and an unbalanced feeding structure coupled to the signal wing, wherein the unbalanced feeding structure is boarded by a plurality of vias coupled to the ground layers, wherein the plurality of ground layers comprise a first ground layer and a second ground layer, and wherein the least one ground wing includes a first ground wing coupled to the first ground layer and a second ground wing coupled to the second ground layer.

2. The apparatus of claim 1, wherein the unbalanced feeding structure is a stripline routed between the first ground layer and the second ground layer.

3. The apparatus of claim 2, wherein the signal wing and the unbalanced feeding structure form an antenna used to propagate signals in a frequency band.

4. The apparatus of claim 3, wherein the antenna is printed on a layer of the substrate between the first ground layer and the second ground layer.

5. The apparatus of claim 3, wherein the frequency band is a 60 GHz frequency band.

6. The apparatus of claim 1, wherein the unbalanced feeding structure further comprises a tapered balun.

7. The apparatus of claim 6, wherein the tapered balun extends from at least one of the plurality of ground layers to the signal wing.

8. The apparatus of claim 7, wherein the tapered balun is shaped as a trapezoid, wherein a first base of the trapezoid is narrower than a second base of the trapezoid, wherein the first base of the trapezoid is closer to the signal wing than the second base of the trapezoid.

9. The apparatus of claim 1, further comprising at least one signal director, wherein the at least one signal director is placed in front of the at least one ground wing and the signal wing.

10. A computing device, comprising:

a substrate comprising a plurality of ground layers;

a signal wing and at least one ground wing, the ground wing coupled to at least one of the plurality of ground layers;

an unbalanced feeding structure coupled to the signal wing, wherein the unbalanced feeding structure is boarded by a plurality of vias coupled to the ground layers; and a radio frequency (RF) circuit configured to transmit or receive signals via the signal wing and the at least one ground wing, wherein the plurality of ground layers comprise a first ground layer and a second ground layer, and wherein the least one ground wing includes a first ground wing coupled to the first ground layer and a second ground wing coupled to the second ground layer.

* * * * *